United States Patent [19]

Bigelow, Jr. et al.

[11] Patent Number: 4,470,227

[45] Date of Patent: Sep. 11, 1984

[54] BUILDING CORE

[76] Inventors: Floyd E. Bigelow, Jr.; Floyd E. Bigelow, III; William H. Bigelow, all of P.O. Box 7064, Houston, Tex. 77008

[21] Appl. No.: 443,382

[22] Filed: Nov. 22, 1982

[51] Int. Cl.[3] ..... E04H 1/00

[52] U.S. Cl. ..... 52/79.1; 52/34; 52/143; 52/234; 108/56.1

[58] Field of Search ..... 52/34, 79.1, 79.5, 143, 52/221, 234, 236.3, 240; 108/56.1, 53.1, 55.3; 248/346

[56] References Cited

U.S. PATENT DOCUMENTS

| | | | |
|---|---|---|---|
| 1,912,847 | 6/1933 | Klepel | 108/53.1 X |
| 3,110,907 | 11/1963 | King | 52/79.1 X |
| 3,162,863 | 12/1964 | Wokas | 52/34 |
| 3,727,753 | 4/1973 | Starr et al. | 52/79.5 X |
| 3,799,382 | 3/1974 | Munroe | 108/56.1 |
| 4,171,596 | 10/1979 | Varlonga | 52/143 X |
| 4,221,441 | 9/1980 | Bain | 52/79.1 X |
| 4,327,529 | 5/1982 | Bigelow et al. | 52/34 |
| 4,364,206 | 12/1982 | Wybauw | 52/79.1 |

*Primary Examiner*—J. Karl Bell

*Attorney, Agent, or Firm*—Vinson & Elkins

[57] ABSTRACT

A fixture core including plumbing for a building in which all of the fixtures are either permanently or temporarily supported from the side walls of the core and the core is transported on a shipping pallet which served as a template for the erection of the core and the fixtures and is removable when the core reaches the job site so that the fixture core may be removed from the pallet, if desired, and supported directly upon the floor or slab of a building in which the core is to be installed.

9 Claims, 12 Drawing Figures

FIG. 8
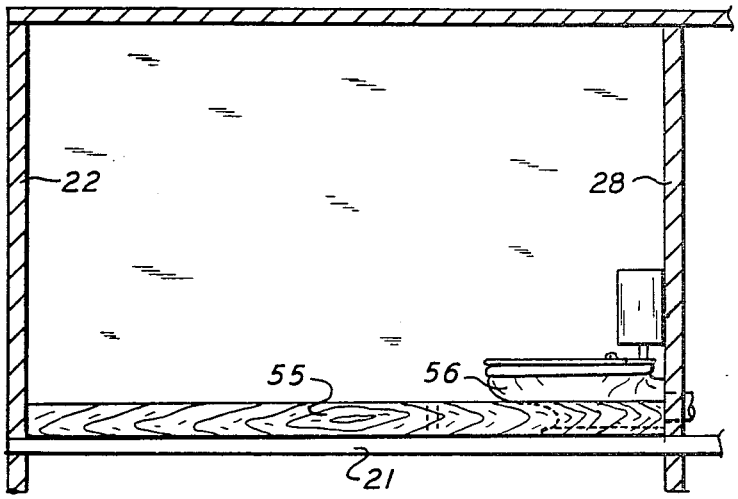
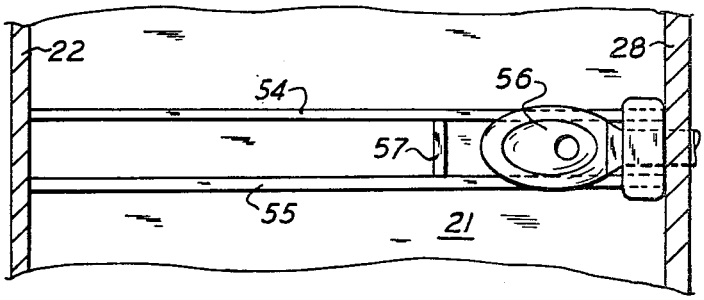
FIG. 9
FIG. 12
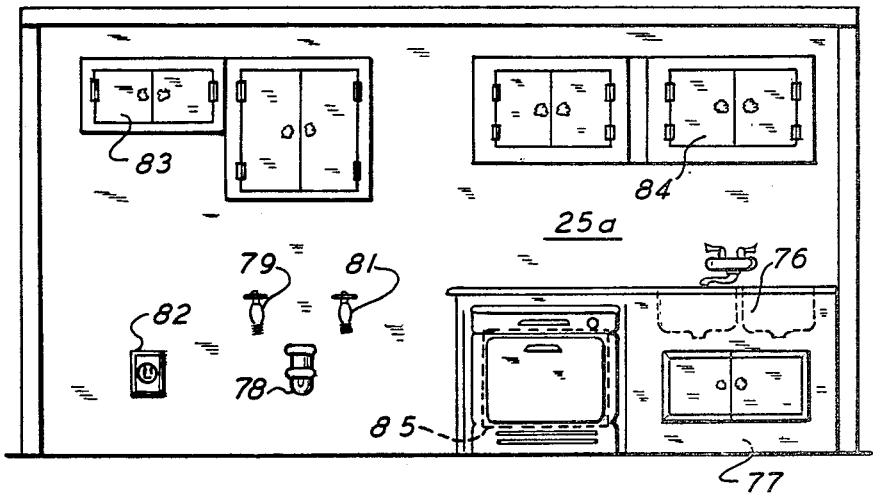

BUILDING CORE

This invention relates to buildings and more particularly to a fixture core for a building.

Fixture cores have been utilized in the past for buildings. See U.S. Pat. No. 4,327,529. The core of this invention utilizes the teaching of said patent in providing for all plumbing within a single room which may be entered from the exterior of the building.

One problem encountered with the core of the above referenced patent and other building cores is that they have all been built on a floor of some type and thus if the core includes the fixtures for the building, such fixtures are supported on the floor of the core which floor is raised relative to the remainder of the building in which the core is used, or the building must be specially prepared with a depressed area to receive the core.

An object of this invention is to provide a fixture core for a building which includes fixtures supported from the wall of the core; the core being floorless so that it may be supported directly upon a slab or the like of a building in which the core is to be used.

Another object is to provide a core and a method of construction of a core in which fixtures are supported from the walls of the core and the core is erected on a shipping pallet which functions as a template for erecting the walls, fixtures and equipment and which pallet may at the option of the user remain in place as the core is erected in a building, or may be removed to permit the core to be erected directly upon the slab or other floor of the building.

Another object is to provide a method and apparatus as in the preceding object in which fixtures include all of the bathroom fixtures and at least a portion of the kitchen fixtures of a building.

Another object is to provide a fixture core for a building in which the core is supported on a detachable shipping pallet and means are provided at the external corners of the core which provide lifting points, guides for nesting one core on top of the other for shipping, and protects the core against damage during handling and provides supports for bands which may surround the core and inhibit entry into the core.

Another object is to provide a fixture core for a building in which the core is floorless and fixtures are supported from the walls of the core during shipping; the bottom of the fixtures and supports therefor extending in the plane defined by the bottom of the core so that when the core is placed upon a floor in a building the fixtures and supports are additionally supported upon such floor.

Other objects, features and advantages of the invention will be apparent from the drawings, the specificaton and the claims.

In the drawings wherein illustrative embodiments of this invention are shown, and wherein like reference numerals indicate like parts:

Figure 10:
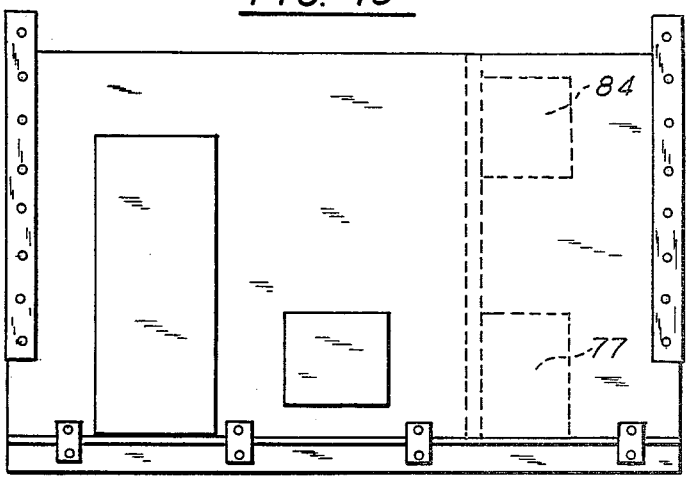
Figure 6:
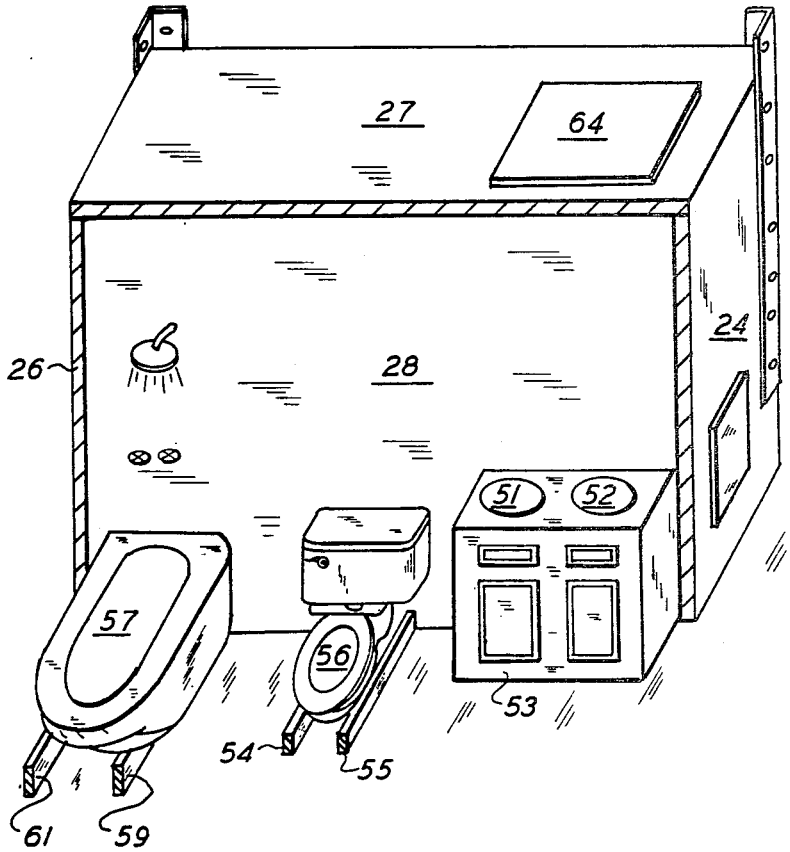
Figure 7:
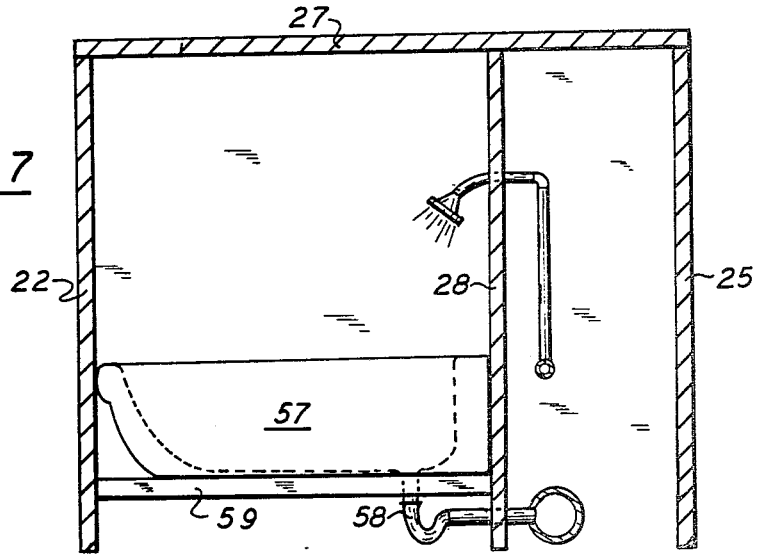
Figure 11:
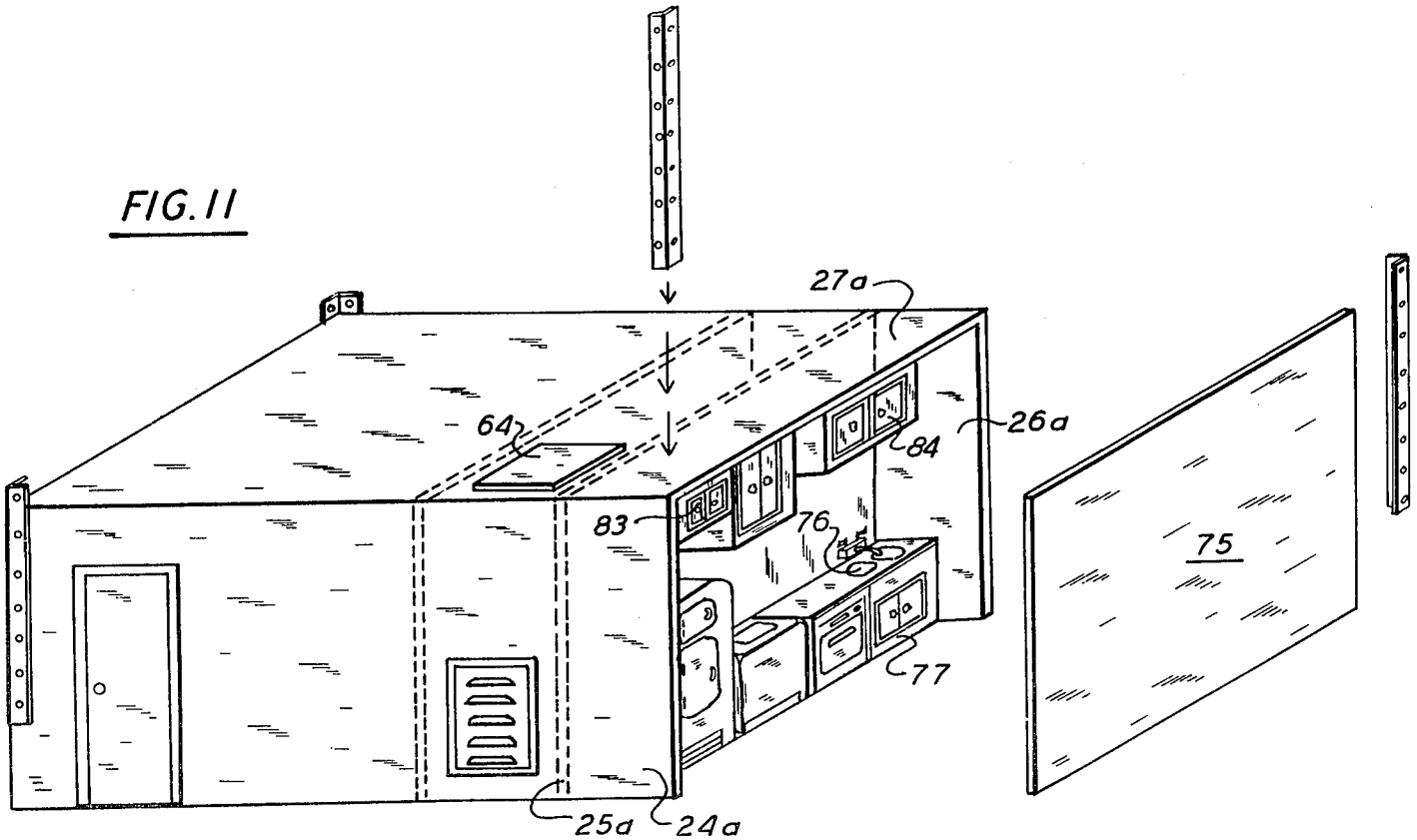

FIG. 6 is a schematic view of the core with the walls 24 and 26, as well as the roof 27, cut away at the internal wall 28 to illustrate the mounting of the tub, toilet and lavatories thereon;

FIG. 7 is a sectional view through the core illustrating the support of the tub within the core;

FIG. 8 is a sectional view through the core illustrating the support of the commode;

FIG. 9 is a sectional view from the top illustrating the support of the commode during shipping;

FIG. 10 is a view in elevation of a modified form of core which includes kitchen figures;

FIG. 11 is an exploded view of the core of FIG. 10 showing the end wall 75 and angle members removed; and FIG. 12 is an end view of the core looking at the kitchen fixtures with the protective wall 75 removed.

Figure 1:
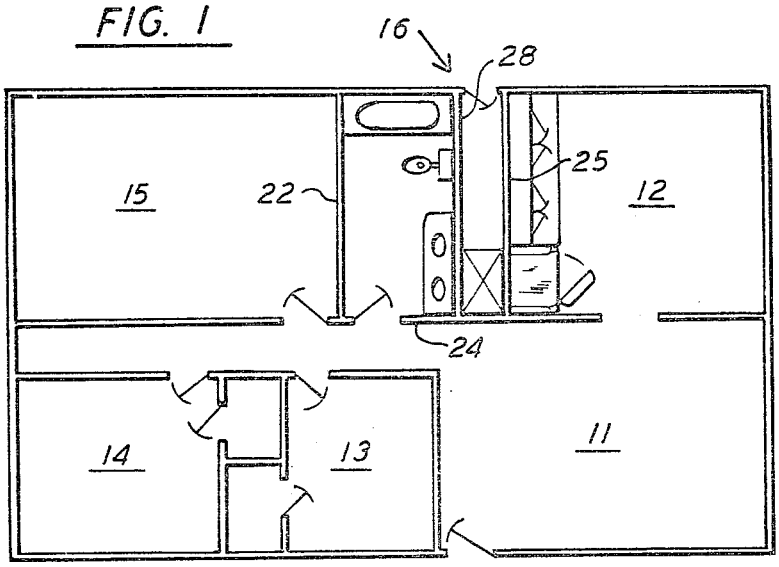
FIG. 1 is a plan view of a building employing the core of this invention.
Figure 5:
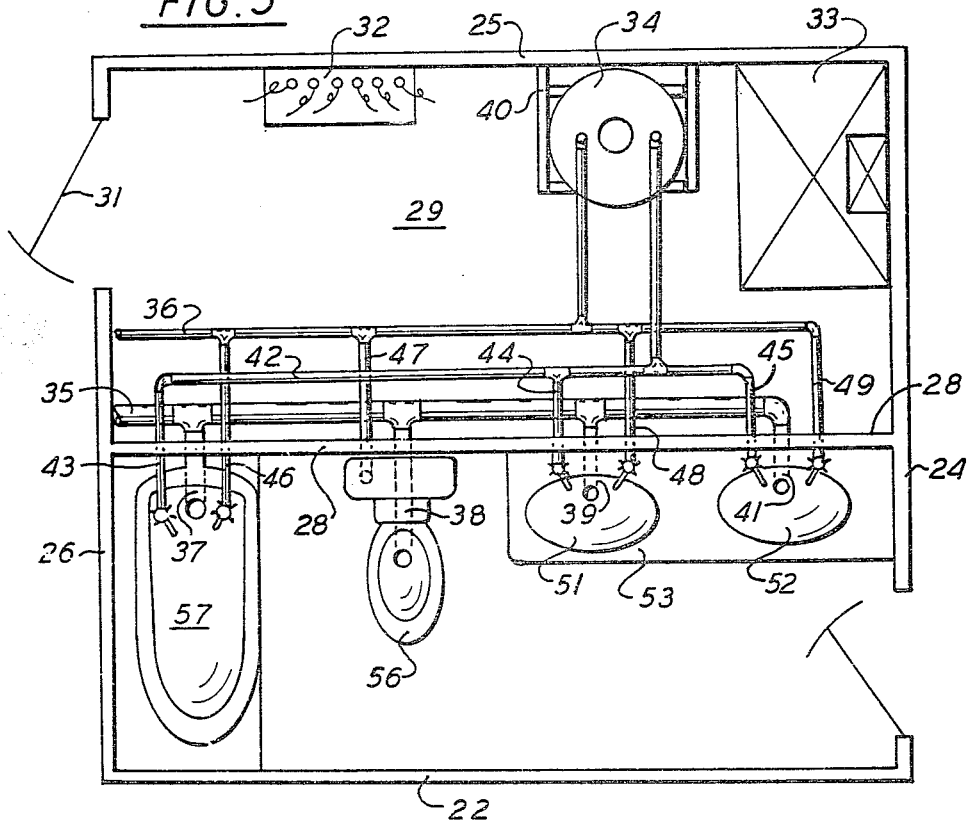
FIG. 5 is a plan view of one form of core.

In FIG. 1 there is shown a floor plan of a typical building having a living room 11, a kitchen 12, three bedroom 13, 14, and 15, and a core indicate generally at 16 constructed in accordance with this invention. The core will include all plumbing and preferably the electrical junction box and air conditioning evaporator and fan, if such is provided in the building. The kitchen fixtures may form a part of the core or they may be installed after the core has been placed in a building.

In accordance with this invention, the core is provided by being erected upon a shipping pallet which functions as a template during erection of the walls of the core and erection of the fixtures therein so that fixtures or supports for the fixtures will be supported by the walls of the core and by the shipping pallet during shipping. At the building site the shipping pallet may be utilized if a built up structure is provided and provisions are made for receiving the shipping pallet, or in the case of a slab if a depression has been left for the shipping pallet. Preferably, in the case of a slab or other level floor construction, the shipping pallet will be removed and the core will support the several fixtures and supports therefor as the core is lifted from the shipping pallet and lowered into place on the floor of a building in which it is to be used. When in place fixtures and supports are also supported by the floor of a building.

During erection of the core on the pallet, the walls of the core and all of the fixtures are temporarily supported on the pallet while they are secured in place and the fixtures are secured to the walls. Thus, the bottom of all of the walls of the core and all of the fixtures or supports for the fixtures will extend in a plane defined by the top surface of the shipping pallet. When the core is lifted from the shipping pallet and placed on the floor of a building, not only the core walls, but all of the fixtures and the supports for fixtures will be supported on the floor of the building. In some cases temporary supports will be utilized, such as supports for a commode, and after the core is in place in a building, these temporary supports may be removed. In other instances supports, such as those under a tub, may rest upon the floor and provide support for the tub. Other equipment may have been placed on the shipping pallet and then tied to and supported from the walls so that when the core is placed in a building such other equipment is supported not only from the walls of the core, but also upon the floor of the building in which the core is installed.

Figure 2:
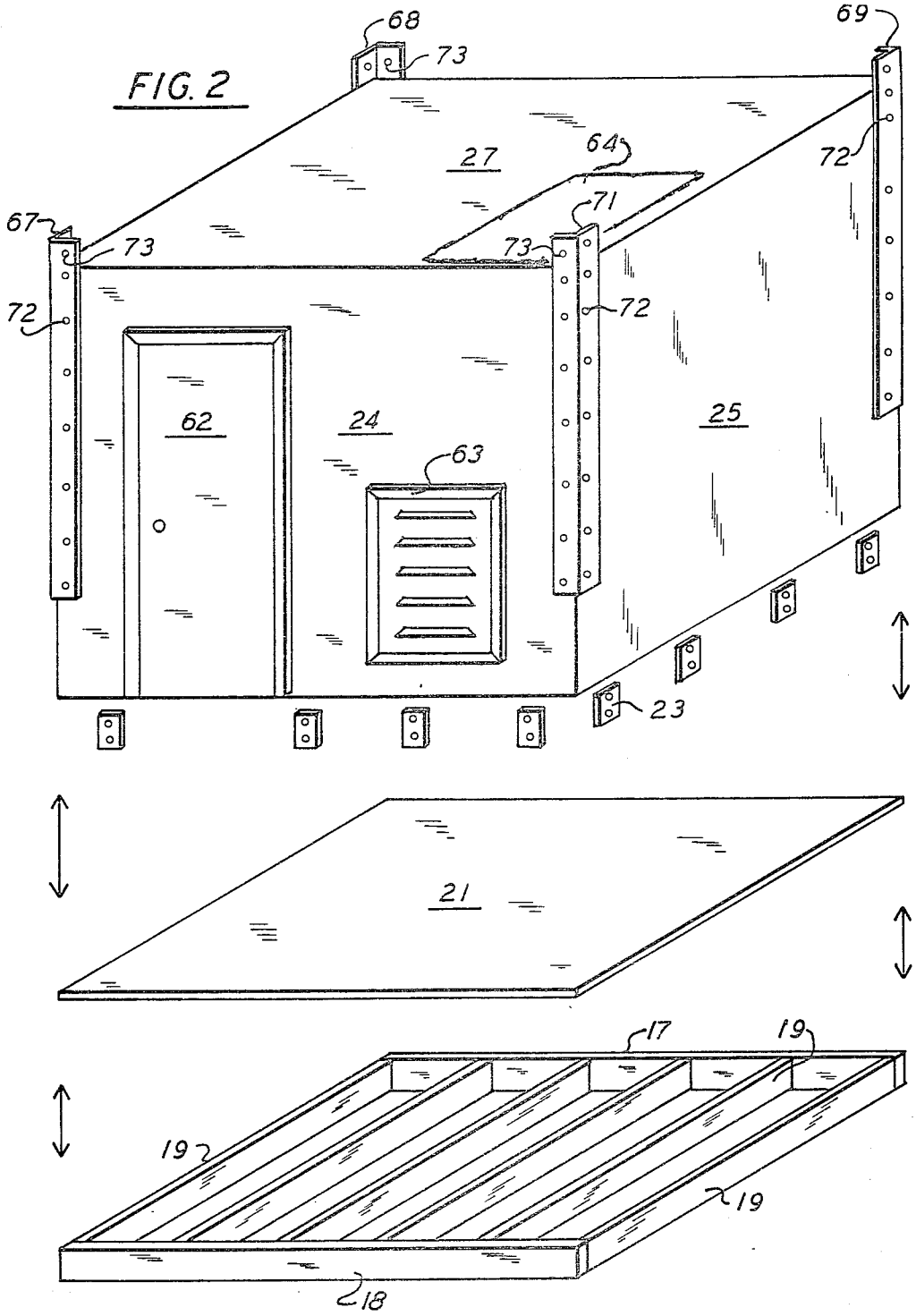
FIG. 2 is an exploded view of the structure and floor of the shipping pallet and of the core to be supported thereby.

Referring now to the drawings, and particularly to FIG. 2, a shipping pallet is made up of spaced structural members which, if the pallet is to be thereafter used as a wall of the building, will provide the lower plate 17 and the support plate 18. If desired, these structural mem ers may be provided by one structural member or by double parallel structural members to conform to the construction of the building in which the shipping pallet may be used as a section of a wall. Cross members 19 will provide studs of a wall section if the pallet is to be used as a section of a wall. While functioning as a shipping pallet, they serve as floor joists to support the floor 21 which provides the upper surface of the shipping pallet and may provide a surface of a wall of the building if the pallet is used as a portion of the building wall. The plates and studs, as well as the floor, may be secured together in any desired manner to provide a substantially rigid shipping pallet and to provide a flat surface on the top of the pallet which will function as a template during erection of the walls of the core and the fixtures and equipment therein.

Figure 4:
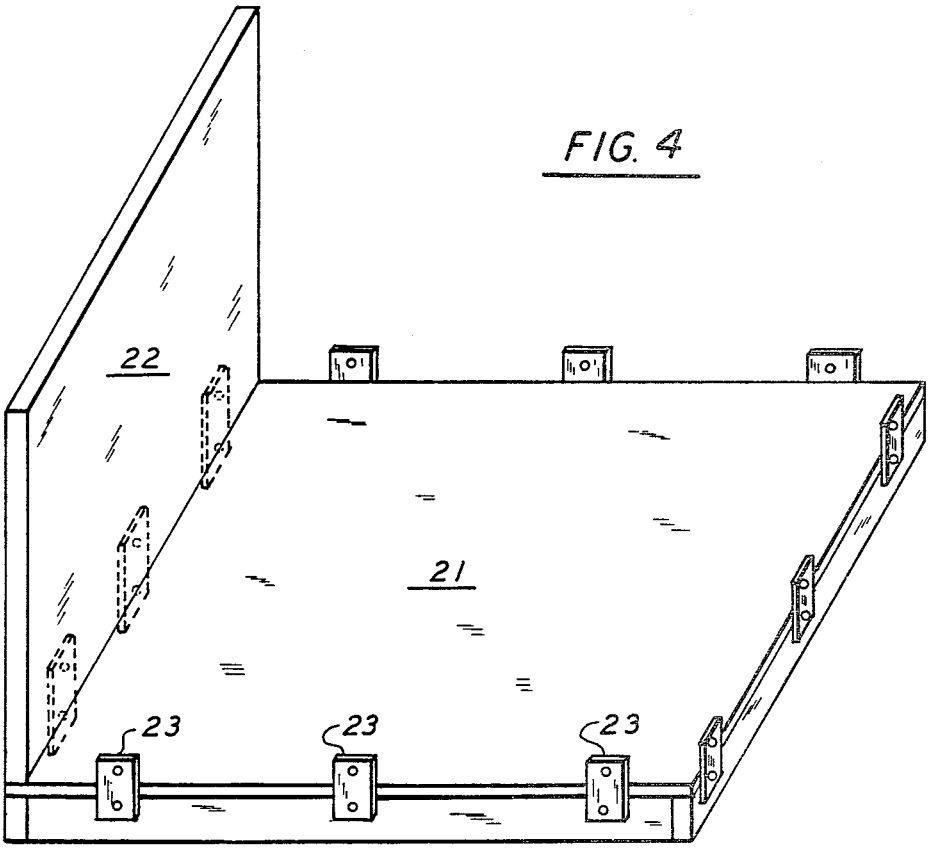
FIG. 4 is a schematic view illustrating the erection of one wall of the core on the shipping pallet.

After the pallet is built the core is erected on the pallet, as indicated in FIG. 4, by erecting the several walls of the core, such as the side wall 22, directly upon the floor of the shipping pallet. Preferably, a plurality of metal tie members 23 are secured to the periphery of the shipping pallet and the walls, such as wall 22, are rested on the pallet and abutted against the ties 23 and secured thereto by suitable screws. The ties 23 will hold the wall 22 in place temporarily while the remaining walls are erected and fastened to each other. As the top surface 21 of the shipping pallet acts as a template, the bottom of all of the walls of the core will lie in a single plane.

In addtion to the wall 22 the several walls 24, 25 and 26 will be erected about the periphery of the shipping pallet to form the core, as shown in FIG. 2. Preferably, the core will include a top 27 which provides a ceiling for the core and also provides a weatherproof cover for the core, if desired. It is preferred that the ceiling and all of the external walls be at least weather resistant to protect the core during shipment between the factory and the erection point. Of course, when erected the core will normally be inside of the building, except that the wall 26 is preferably an exterior wall. The wall 26 may be formed of the same material as the exterior of the remainder of the building, or exterior wall covering may be applied over the wall 26 after the core is in place. In addition to the exterior walls, one or more internal walls, such as wall 28, will be provided to separate the bathroom proper from the room 29 to which access may be had through door 31. The room 29 preferably contains the electrical breaker box 32, the air conditioning unit 33, the hot water heater 34, the sewer line 35, and the water supply line 36. All of these elements are secured to the walls of the core and are supported thereby. The water heater is supported in a suitable support 40 carried by wall 25. The wall 28 has extending therethrough branch sewer lines 37, 38, 39 and 41 which connect to the tub, commode and lavatories, respectively. The sewer line and branches are supported from the wall 28. Also extending through wall 28 and supported thereon is the hot water line 42 and its several branches 43, 44 and 45, which connect to the tub and lavatories. The cold water line 36 has branch lines 46, 47, 48 and 49 which connect, respectively, to the tub, commode and lavatories.

All of the walls of the unit will preferably be erected first and then the fixtures will be supported upon the shipping pallet while they are tied to the several walls of the core. In like manner the air conditioning unit and hot water heater may be supported upon the pallet while they are installed and fixed to the walls of the core. All of the plumbing is supported by the walls of the core and principally by the internal wall 28.

During installation the lavatories 51 and 52 are installed as a portion of the cabinet 53. The cabinet will rest upon the shipping pallet while it is being attached to the internal wall 28. In like manner, the toilet will rest upon the pallet while being installed and secured to the wall 28. Where the type of toilet which rests upon the floor is utilized, a pair of supporting members 54 and 55 extend between the wall 28 and the wall 22, as best shown in FIGS. 8 and 9. These supporting members underlie the toilet and support the weight thereof. Members 54 and 55 may be joined by a tie member 57 extending therebetween, as shown in FIG. 9, if desired.

The tub 57 need be positioned above the floor a sufficient distance to permit the water trap 58 to be positioned above the shipping pallet, as shown in FIG. 7. For this purpose the tub is supported on a pair of support members 59 and 61 which extend between the wall 28 and wall 22. If desired, a fiberglas tub which is hung from the walls may be utilized.

Figure 3:
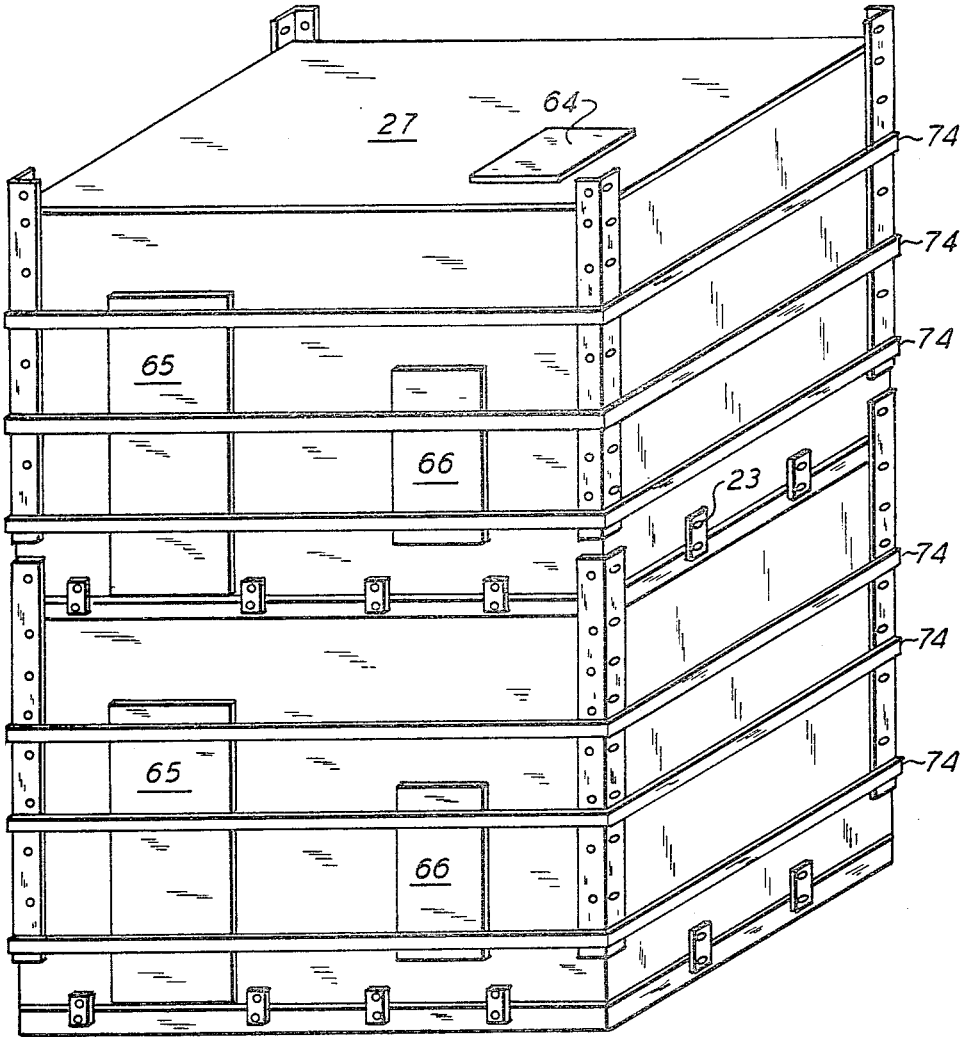
FIG. 3 is a schematic view of a pair of cores stacked one upon the other.

The wall 24 may have a suitable door 62 and return air grill 63. Where air conditioning is installed, the core is provided with a space for a plenum chamber in the upper end of the air conditioning area and a removable cover 64 may be provided to seal this opening during shipping. In like manner, as shown in FIG. 3, the door 62 will have an overlay of a protective member, such as a plywood panel 65, and the air return 63 will also have an overlay of a plywood protective member 66 to make the unit weathertight and to prevent vandalism.

At each corner of the unit the core is provided with removable angle members, preferably of metal, 67, 68, 69 and 71. These angle members are releasably secured to the core, as by screws 72. The angle members provide at their upper ends lifting holes 73 for receiving hooks of a sling to lift and lower the unit during shipping and installation. ALso, the unit preferably provided with bands 74 to provide security for the units and make it difficult to gain entry into the core during shipping. The corner members and the bands also protect the core. Preferably, the corner members extend a slight distance above the top of the core to permit the hook of a sling to be readily engaged with the holes 74 and the angle members terminate a slight distance above the shipping pallet. This permits the units to be stacked one upon the other, as shown in FIG. 3, with the angle members acting as guides and as supports to hold these members in stacked condition during shipping.

Reference is now made to FIGS. 10, 11 and 12 in which the core includes kitchen fixtures. The core may be identical to that hereinabove described, except that the walls and roof extend beyond wall 25 which is shown at **25*a* in the manner illustrated at 27*a*, 24*a* and 26*a*. A removable end wall 75 is releasably attached to the roof 27*a* and the side walls 24*a* and 26*a*. Within the space provided between the removable wall 75 and the wall 25*a*, kitchen fixtures may be provided. For instance, the double sink 76 may be supported in the cabinet 77 which is hung from the wall 25*a*. Also a sewer line 78 and hot and cold water outlets 79 and 81 may be provided in wall 25*a* for a clothes washing machine. An electrical receptable 82 may be provided for a dryer. Also cabinets 83 and 84 may be hung on the wall 25*a*, if desired. The lower cabinet 77 may contain a dishwasher, as indicated in dash line at 85. Again, the dishwasher, cabinets and the like would be supported from the wall 25***a*, but would be positioned on the pallet during construction so that the pallet would act as a template for this equipment.

When the core is to be erected on a slab, the core is released from the ties 23 to release it from the shipping pallet. It is lifted and placed on the floor, such as the slab of the building in which it is to be used. When in position, the fixtures or the supports therefor which require support will rest upon th floor and be supported thereby. Thus, during use the tub, the lavatories, the commode, hot water heater, etc., are supported on the slab of the building in which the core is erected, and while they are tied to the walls of the core, additional support is provided by the floor of the building. Thus, the support from the walls of the building need only be that required to suppot the equipment during shipping, as additional support will be provided by the floor of the building during use of the equipment. Of course, if the shipping pallet is to be left in place and provide a floor for the unit, the shipping pallet will serve this function.

After erection the shipping pallet may be utilized as a wall, floor or ceiling section of the building as may the removable wall 75 which provided a protective cover over the kitchen fixtures during shipping, as indicated in FIG. 11.

The foregoing disclosure and description of the invention is illustrative and explanatory thereof and various changes in the size, shape and materials, as well as in the details of the illustrated construction, and various changes in the process may be made within the scope of the appended claims without departing from the spirit of the invention.

What is claimed is:

1. A utility core for a building comprising: a shipping pallet including horizontally extending structural members and a floor over said members; a utility core resting on said floor and releasably secured to said pallet; said core comprising: a plurality of external walls interconnected with each other and supported upon and releasably secured to said pallet; a ceiling extending between and connected to said walls; a first room containing water and sewage piping; a second room having a first common internal wall with said first room; and bathroom fixtures and supports therefor resting on the floor of said pallet and secured to and supported by said walls; said fixtures connected through said first wall with said water and sewage piping.

2. The system of claim 1 wherein said pallet is constructed of upper and lower plates interconnected by studs suitable for use as a wall of a building.

3. The system of claim 1 wherein said pallet is constructed of joists and at least one plate suitable for use as a floor or ceiling section of a building.

4. The system of claim 1 wherein removable right angle structural members are provided at each external corner of the core and extend above the roof of the core and are spaced above the bottom of the pallet to provide lifting points, to protect the core during shipping, to provide guides for stacking multiple cores, and to support bands for securing covers over openings in said cores.

5. The system of claim 1 wherein those bathroom fixtures which are not supported on the walls of the core are supported on members extending between said walls.

6. The system of claim 1 wherein those bathroom fixtures which are not supported on the walls of the core are supported on members extending between said walls, and wherein said members are removable when said bathroom fixtures are supported on the floor of a building in which the core is installed.

7. The system of claim 1 wherein said first room includes a second internal wall, and kitchen fixtures are supported on said second internal wall on the side opposite said first room, said external core walls including a removable wall extending parallel to said second internal wall and overlying said kitchen fixtures.

8. The system of claim 1 wherein said first room includes a second internal wall, kitchen fixtures are supported on said second internal wall on the side opposite said first room, said external core walls include a removable wall extending parallel to said second internal wall and overlying said kitchen fixtures, and said removable wall is constructed of an upper and lower plate interconnected by studs which may form a wall, floor or ceiling section of a building containing said core.

9. The method of constructing a utility core for a building comprising: constructing a pallet of structural members with a floor on top; supporting a plurality of walls on said floor with the exterior surface of the exterior walls positioned at the outer periphery of the pallet; releasably connecting said exterior walls of said pallet; connecting a roof to said walls and said walls to each other to provide a unitary self supporting structure; supporting fixtures and supports for fixtures on the floor of said pallet while securing said fixtures and supports therefor to said walls; and supporting plumbing for said fixtures from said walls and connecting said plumbing to said fixtures.

* * * * *